US008857769B1

(12) United States Patent
Hogan

(10) Patent No.: US 8,857,769 B1
(45) Date of Patent: Oct. 14, 2014

(54) VARIABLE FREQUENCY TRAIN DETECTION

(71) Applicant: Siemens Industry, Inc., Alpharetta, GA (US)

(72) Inventor: Brian Hogan, Temecula, CA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 13/874,059

(22) Filed: Apr. 30, 2013

(51) Int. Cl.
*B61L 23/34* (2006.01)
*B61L 1/02* (2006.01)

(52) U.S. Cl.
CPC ..... *B61L 1/02* (2013.01)
USPC ..... 246/122 R; 701/19

(58) Field of Classification Search
CPC ..... B61L 1/00; B61L 1/02; B61L 1/187; B61L 1/188; B61L 1/18; B61L 29/286; B61L 29/226; B61L 29/28; B61L 29/22; B61L 29/32; B61L 29/00; B61L 23/34
USPC ..... 246/111, 130, 122 R, 202, 208, 123, 246/124, 125, 220
See application file for complete search history.

(56) References Cited

U.S. PATENT DOCUMENTS 5,170,970 A * 12/1992 Ballinger ..... 246/34 R
5,868,360 A * 2/1999 Bader et al. ..... 246/202
6,292,112 B1 * 9/2001 Bader et al. ..... 340/941
6,604,031 B2 * 8/2003 Oguma et al. ..... 701/19
7,254,467 B2 * 8/2007 Fries et al. ..... 701/19
7,975,968 B2 * 7/2011 Bohlmann et al. ..... 246/122 R
8,157,219 B2 * 4/2012 Ashraf et al. ..... 246/130
8,297,558 B2 * 10/2012 O'Dell et al. ..... 246/126
8,500,071 B2 * 8/2013 O'Dell ..... 246/293
8,515,697 B2 * 8/2013 Alexander et al. ..... 702/58
8,517,316 B2 * 8/2013 Baldwin et al. ..... 246/130
8,590,844 B2 * 11/2013 Hogan ..... 246/34 B
2004/0181321 A1 * 9/2004 Fries et al. ..... 701/19
2008/0169385 A1 * 7/2008 Ashraf et al. ..... 246/130
2010/0108823 A1 * 5/2010 Barnes ..... 246/111
2011/0011985 A1 * 1/2011 Hogan ..... 246/34 R
2011/0174934 A1 * 7/2011 Kikuchi et al. ..... 246/122 R
2012/0181390 A1 * 7/2012 Ashraf et al. ..... 246/122 R
2013/0062474 A1 * 3/2013 Baldwin et al. ..... 246/122 R
2013/0248658 A1 * 9/2013 Takagi ..... 246/122 R
2013/0299645 A1 * 11/2013 Cooper et al. ..... 246/122 R

* cited by examiner

*Primary Examiner* — Jason C Smith

(57) ABSTRACT

A method and device capable of reliable and accurate train prediction determinations that account for, and overcome the problems associated with, changing ballast conditions. The method and device will detect the presence of a train in an approach area based on a rail characteristic measured in relation to a first measurement frequency transmitted along the rails. If there is a condition such as a ballast condition that may affect the rail characteristic, the method and device will detect the distance and speed of the train based on a rail characteristic measured in relation to a second measurement frequency transmitted along the rails. Otherwise, the distance and speed of the train will be determined based on the rail characteristic measured in relation to the first measurement frequency.

17 Claims, 2 Drawing Sheets

VARIABLE FREQUENCY TRAIN DETECTION

FIELD

Embodiments of the invention relate to railroad constant warning time devices and, more particularly, to a constant warning time device using a variable frequency train detection process.

BACKGROUND

A constant warning time device (often referred to as a crossing predictor or a grade crossing predictor in the U.S., or a level crossing predictor in the U.K.) is an electronic device that is connected to the rails of a railroad track and is configured to detect the presence of an approaching train and determine its speed and distance from a crossing (i.e., a location at which the tracks cross a road, sidewalk or other surface used by moving objects). The constant warning time device will use this information to generate a constant warning time signal for controlling a crossing warning device. A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Constant warning time devices are often (but not always) configured to activate the crossing warning device at a fixed time (e.g., 30 seconds) prior to an approaching train arriving at a crossing.

Typical constant warning time devices include a transmitter that transmits a signal over a circuit formed by the track's rails and one or more termination shunts positioned at desired approach distances from the transmitter, a receiver that detects one or more resulting signal characteristics, and a logic circuit such as a microprocessor or hardwired logic that detects the presence of a train and determines its speed and distance from the crossing. The approach distance depends on the maximum allowable speed of a train, the desired warning time, and a safety factor. Preferred embodiments of constant warning time devices generate and transmit a constant current AC signal on said track circuit; the constant warning time devices detect a train and determines its distance and speed by measuring impedance changes caused by the train's wheels and axles acting as a shunt across the rails, which effectively shortens the length (and hence lowers the impedance) of the rails in the circuit. Multiple constant warning devices can monitor a given track circuit if each device measures track impedance at a different frequency. Measurement frequencies are chosen such that they have a low probability of interfering with each other while also avoiding power line frequencies (e.g. 60 Hz) and traction power frequencies (e.g., 25 Hz, 100 Hz) as well as second and third harmonics thereof.

As is known in the art, railroad tracks are installed using railroad ties and a trackbed consisting of stone or other suitable material referred to as a ballast. The ballast is packed between, below, and around the ties and is used to allow water drainage, bear the load from the railroad ties, and to hold the track in place as trains roll by. The track length and ballast determine the upper frequency that a constant warning time device can use to reliably determine train position. It is known that the ballast can degrade and/or cause current leakage over time. Moreover, the ballast condition can change due to the weather conditions. Therefore, the ballast can have a resistance that effects the impedance of the train circuit, making the prediction of an approaching train more difficult and prone to errors. Thus, due to the shunting action of the ballast, train position is more accurately detected at low frequencies.

The track circuit of interest for the constant warning time device is the "approach" (i.e., the area from a termination shunt to the crossing), which is confined in frequency by the termination shunts. The lower the frequency the larger the shunt. Practically speaking, however, termination shunts have a lower frequency limit due to their physical size. For example, shunts become prohibitively large, which is undesirable, when trying to get down to a low frequency of e.g., 45 Hz. Even if the track circuit could accommodate the larger shunts, they are still not desirable because of the costs and manpower required to replace existing shunts. As such, larger termination shunts should not be used to overcome the effects caused by the ballast conditions.

Thus, there is a need and desire for a reliable and accurate train prediction determination that can account for, and overcome the problems associated with, changing ballast conditions.

DETAILED DESCRIPTION

Embodiments disclosed herein provide a method and device capable of reliable and accurate train prediction determinations that account for, and overcome the problems associated with, changing ballast conditions. The method and device will detect the presence of a train in an approach area based on a rail characteristic measured in relation to a first measurement frequency transmitted along the rails. If there is a condition such as a ballast condition that may affect the rail characteristic, the method and device will detect the distance and speed of the train based on a rail characteristic measured in relation to a second measurement frequency transmitted along the rails. Otherwise, the distance and speed of the train will be determined based on the rail characteristic measured in relation to the first measurement frequency.

Figure 1:
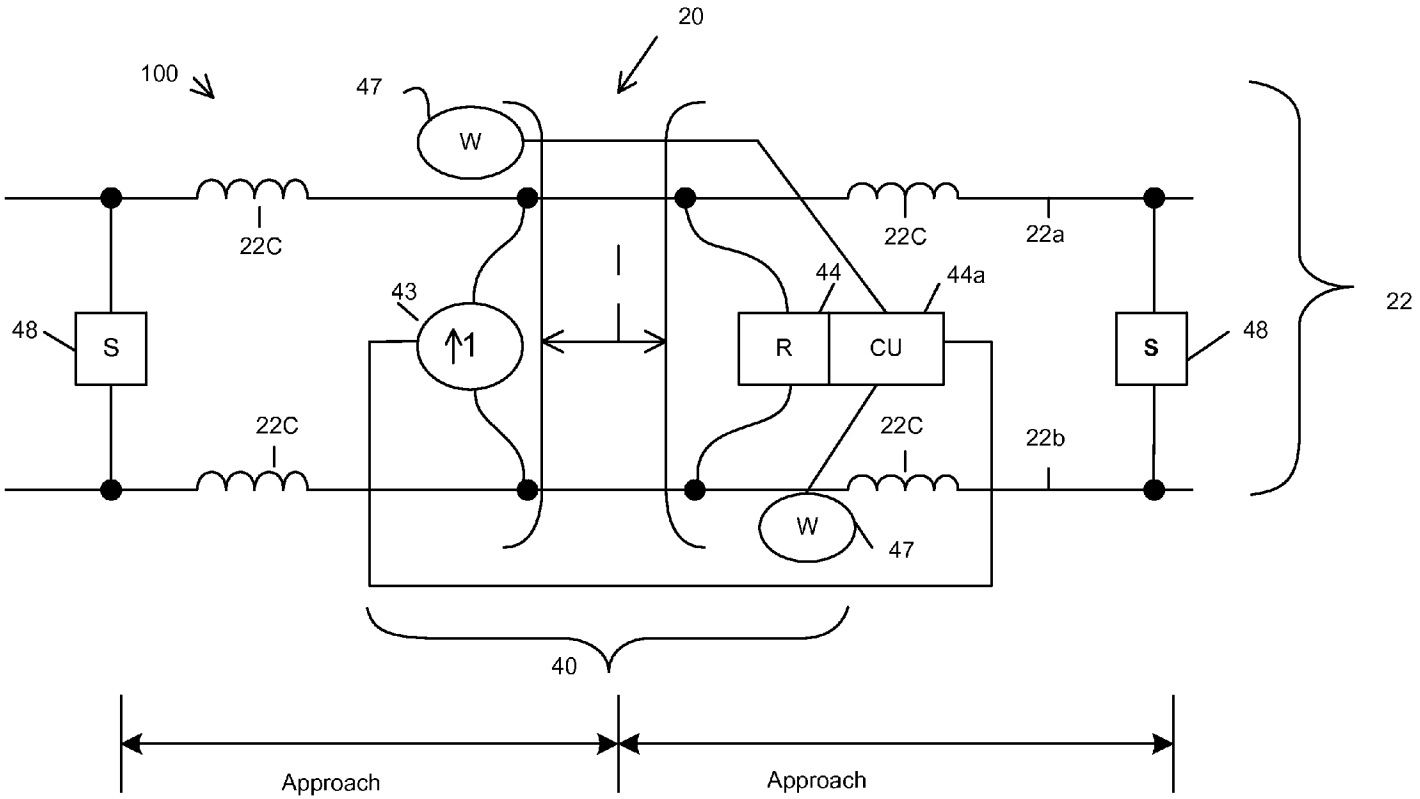
FIG. 1 illustrates a circuit diagram of a track circuit with a constant warning time device in accordance with an embodiment disclosed herein.

FIG. 1 illustrates a track circuit 100 at a location in which a road 20 crosses a railroad track 22. The railroad track 22 includes two rails 22*a*, 22*b* and a plurality of ties (not shown in FIG. 1) that are provided over and within railroad ballast to support the rails. The rails 22*a*, 22*b* are shown as including inductors 22*c*. The inductors 22*c*, however, are not separate physical devices but rather are shown to illustrate the inherent distributed inductance of the rails 22*a*, 22*b*.

The track circuit 100 includes a constant warning time device 40 that comprises a transmitter 43 connected across the rails 22*a*, 22*b* on one side of the road 20 and a receiver 44 connected across the rails 22*a*, 22*b* on the other side of the road 20. Although the transmitter 43 and receiver 44 are connected on opposite sides of the road 20, those of skill in the art will recognize that the components of the transmitter 43 and receiver 44 other than the physical conductors that connect to the track 22 are often co-located in an enclosure located on one side of the road 20. The transmitter 43 and receiver 44 are also connected to a control unit 44*a*, which is also often located in the aforementioned enclosure. The control unit 44*a* is connected to and includes logic for controlling warning devices 47 at the crossing of the road 20 and the track 22. The control unit 44*a* also includes logic (which may be implemented in hardware, software, or a combination thereof) for calculating train speed and producing constant warning time signals for its crossing.

Also shown in FIG. 1 are a pair of termination shunts 48, one on each side of the road 20 at a desired approach distance. Thus, the rails 22*a*, 22*b* on each side of the road 20 have an approach area defined by the shunt 48. The shunts 48 may be simple conductors, but are typically tuned circuit AC circuits configured to shunt the particular frequency being transmitted by the transmitter 43. An example of a frequency selectable shunt is disclosed in U.S. Pat. No. 5,029,780, the entire contents of which are hereby incorporated herein by reference. Those of skill in the art will recognize that unidirectional circuits with a single shunt are also possible and within the scope of the invention. The transmitter 43 is configured to transmit a constant current AC signal at a particular frequency (referred to herein as a primary frequency, which corresponds to the frequency of the associated shunt or shunts), typically in the audio frequency range, such as 50 Hz-1000 Hz. The receiver 44 measures the voltage across the rails 22*a*, 22*b*, which (because the transmitter 43 generates a constant current AC signal) is indicative of the impedance and hence the inductance of the circuit formed by the rails 22*a*, 22*b* and shunts 48.

If a train heading toward the road 20 crosses one of the shunts 48, the train's wheels and axles act as shunts, essentially shortening the length of the rails 22*a*, 22*b*, which lowers the inductance, impedance and voltage measured by the control unit 44*a*. Measuring the change in the impedance indicates the distance of the train, and measuring the rate of change of the impedance (or integrating the impedance over time) allows the speed of the train to be determined. As a train moves toward the road 20 from either direction, the impedance of the circuit will decrease, whereas the impedance will increase as the train moves away from the receiver 44/transmitter 43 toward the shunts 48.

As noted above, depending upon the condition of the ballast, the ballast will have a resistance that will provide a path for current leakage and that effects the impedance of the train circuit 100, making the prediction of an approaching train more difficult and prone to errors. As also noted above, to overcome this effect, it is desirable and more accurate to detect the train's position at low frequencies—something current track circuits and constant warning time devices cannot do. The embodiments disclosed herein, however, provide a technique for reliable and accurate train prediction that accounts for, and overcomes the problems associated with, changing ballast conditions and does not require increasing the physical size of the shunts 48. That is, since there is the inductive impedance of the rails running in series and the leakage ballast resistance in parallel, if the rail impedance could be made much less than the ballast resistance (i.e., Zrail<<Rballast), then less current would flow through the ballast resistance. Since Zrail is 2*π*frequency*L, where L is the inductance of the track per unit foot, lowering the frequency lowers Zrail and causes less current to flow through the ballast resistance.

The disclosed embodiments utilize the principle that an approaching train's wheels provide a non-frequency specific or broadband shunt to the rails 22*a*, 22*b*. That is, once the train is in an approach, all frequencies are shunted via the train's wheels. This is why multiple primary frequencies can be generated by different constant warning time devices to measure the same track's impedance. Normally, the constant warning time device would determine train position and speed using the track impedance based on the frequency of the termination shunts 48. In the embodiments disclosed herein, once shunting of the primary frequency by a train is detected, a lower supplemental frequency will also be used to enhance the train position determination when a ballast condition that could affect the determination exits. This is possible because the shunting by the train's wheels is not frequency specific. The supplemental frequency will be selected in accordance with the criteria that (1) there must be no interference with other track signals (including other primary and supplemental track circuit frequencies); and (2) the supplemental frequency is optimized for the ballast condition, to the extent possible consistent with criteria (1). Suitable supplemental frequencies can be determined e.g., using a calibration routine or computer modeling of rail response under specific ballast conditions. There can be more than one supplemental frequency, based on e.g., specific ballast conditions or percentages of degradation of the signals on the rails, if desired. In accordance with the disclosed principles, frequencies below 45 Hz can be used to improve the train prediction in low ballast conditions (e.g., typically less than 3 ohms per 1000 feet) without the need to change the termination shunts 48. In one embodiment, the supplemental frequencies can be set by train or maintenance personnel, or any other user of the track circuit 100. In some embodiments, certain supplemental frequencies are associated with corresponding primary frequencies (i.e., frequency selectable devices are constructed so that the same mechanism, such as DIP switch settings or receipt of command signals, controls the selection of both the primary and second frequencies) so that the selection of a primary frequency for a particular track circuit results in an automatic selection of a secondary frequency.

Figure 2:
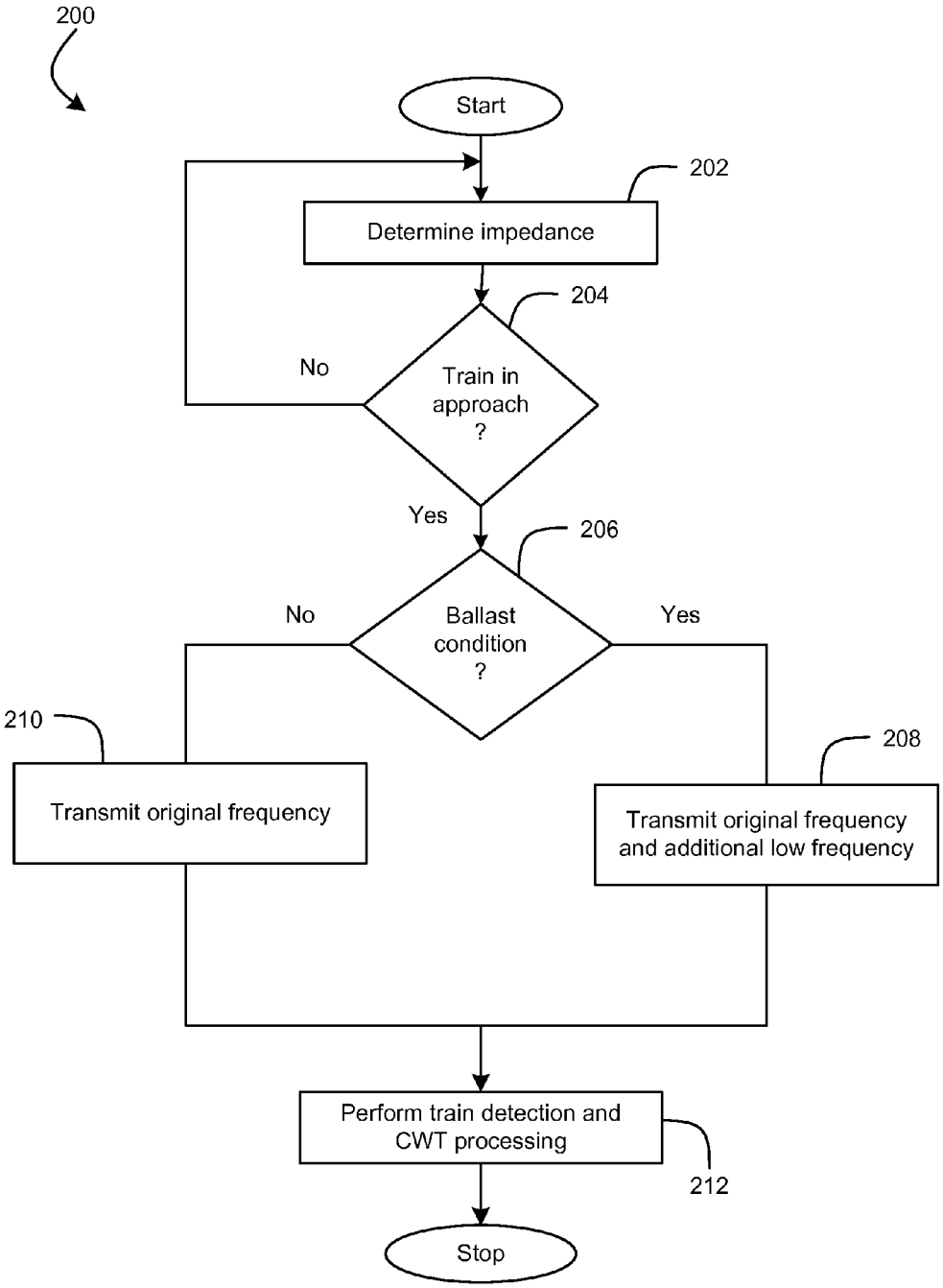
FIG. 2 illustrates an example method performed by the constant warning time device disclosed herein.

FIG. 2 illustrates an exemplary method 200 performed by the constant time warning device 40 in accordance with the disclosed principles. The method 200 can be implemented in software and carried out by the control unit 44*a*. Program instructions for implementing the method 200 can be stored in a non-volatile memory that may be part of, or connected to, the control unit 44*a*. The control unit 44*a* can be a processor or other programmed controller suitable for performing the method 200 and other necessary processing disclosed herein.

The method 200 begins at step 202 where the rail impedance is determined. As mentioned above, the receiver 44 measures the voltage across the rails 22*a*, 22*b*, which (because the transmitter 43 generates a constant current AC signal) is indicative of the impedance of the circuit formed by the rails 22*a*, 22*b* and shunts 48. At step 204, the control unit 44*a* determines if a train is within one of the approach areas. If a train enters one of the approach areas (i.e., it crosses one of the shunts 48), the train's wheels and axles lower the inductance, impedance and voltage measured by the control unit 44*a* (in comparison to the inductance, impedance and voltage expected when only the shunts 48 are connected to the rails). Therefore, at step 204, the control unit 44*a* determines if there has been a change in the impedance and/or voltage that is indicative of a train entering an approach area. If there has been no change, then the method 200 returns to step 202 where the impedance determination is made again. It should be appreciated that a delay could be inserted before making the new determination, if desired.

If, however, at step 204 it is determined that there has been a change in the impedance and/or voltage that is indicative of a train entering an approach area, the method 200 continues at step 206 where the control unit 44*a* determines if there is a ballast or other condition that may adversely impact the train detection and/or constant time warning processes. Any technique for determining whether there is a ballast or other condition that would impact the detection and warning processes may be used. Currently, if such a condition arises, some constant warning time devices enter a motion sensor mode whereby train detection is made using motion sensing. Other systems may simply activate the warning devices 47 to ensure that the road 20 is blocked even if the warning devices 47 are activated too soon. Both of these scenarios are undesirable and inaccurate. According to the disclosed principles, however, if it is determined that such a condition exists at step 206, the method 200 continues at step 208 where the control unit 44*a* causes the transmitter 43 to transmit a constant measurement signal having the original measurement frequency and one or more constant supplement signals having the lower supplemental frequency discussed above. The lower supplemental frequency is not subject to the same problems associated with e.g., a low ballast condition that are experienced with the higher measurement frequency tuned to the termination shunts 48. As such, the disclosed embodiments will better capable of making the train position determination using the rail characteristic based on the supplemental frequency. Once the transmitter 43 begins to transmit the measurement signal having the original measurement frequency and the supplemental signal having the lower supplemental frequency, train detection and constant time warning processing can be performed at step 212 using the impedance/voltage responses based on the supplemental frequency. That is, the train's distance can be determined by the change in the impedance based on the supplemental frequency and the speed of the train can be determined by the rate of change of the impedance (or integrating the impedance over time).

If, on the other hand, the control unit 44*a* determines that there is no ballast or other condition that will adversely impact the train detection process (i.e., a no at step 206), the control unit 44*a* causes the transmitter 43 to transmit a constant measurement signal having the original (primary) measurement frequency at step 210. Once the transmitter 43 begins to transmit the measurement signal having the original measurement frequency, train detection and constant time warning processing can be performed at step 212 using the impedance/voltage responses based on the original measurement frequency. The train's distance can be determined by the change in the impedance based on the measurement frequency and the speed of the train can be determined by the rate of change of the impedance (or integrating the impedance over time). The method 200 terminates after step 212 is completed.

The disclosed embodiments provide several advantages over existing track circuits and constant warning time devices. For example, and as mentioned above, a more reliable and accurate train detection determination can be made without the need for changing the size of termination shunts 48. This saves time, money and manpower. Moreover, seasonal recalibration of the constant warning time device 40 often performed to counteract changing ballast conditions can be reduced and/or eliminated since the disclosed method 200 can be programmed to have one or more supplemental frequencies that are appropriate for known or potential ballast conditions.

In the embodiments described above, the supplemental frequency is transmitted only if there is a ballast or other condition that may adversely impact the train detection and/or constant time warning processes. However, other embodiments may automatically transmit the one or more supplemental frequencies upon detection of a train using the primary frequency signal regardless of whether such a condition is detected. Always using both the primary and supplemental frequencies may result in the use of additional power as compared to the embodiments discussed above, but may result in more reliable detections. Also, it is possible to measure the train's position using both the primary and supplemental frequencies and cross-checking them (for the sake of safety, the signal indicating the shorter time of arrival can be used). Under good ballast conditions, such a cross-check may indicate a problem requiring maintenance.

The foregoing examples are provided merely for the purpose of explanation and are in no way to be construed as limiting. Further areas of applicability of the present disclosure will become apparent from the detailed description, drawings and claims provided hereinafter. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A method of detecting the presence of a train on a railroad track, said method comprising:

transmitting a first signal having a first frequency along rails of the railroad track;

determining if the train is in an approach area based on a characteristic of the rails measured in relation to the first frequency;

in response to determining that a train is in the approach area, determining if there is a condition that could alter the characteristic of the rails, and if it is determined that there is a condition that could alter the characteristic of the rails, transmitting a second signal having a second frequency along rails of the railroad track, and detecting the presence of the train based on the characteristic of the rails measured in relation to the second frequency.

2. The method of claim 1, further comprising detecting the presence of the train based on the characteristic of the rails measured in relation to the first frequency if it is determined that there is no condition that could alter the characteristic of the rail.

3. The method of claim 1, wherein the characteristic of the rails is an impedance of the rails.

4. The method of claim 1, wherein the condition that could alter the characteristic of the rails is a ballast condition.

5. The method of claim 1, wherein the condition that could alter the characteristic of the rails is current leakage through a ballast.

6. The method of claim 1, wherein the second frequency is lower than the first frequency.

7. The method of claim 1, wherein the second frequency is approximately 45 Hz or less.

8. The method of claim 1, further comprising performing constant warning time processing based on the detected presence of the train.

9. A constant warning time device for detecting the presence of a train on a railroad track, said device comprising:

a transmitter adapted to transmit on rails of the railroad track a first signal having a first frequency and a second signal having a second frequency;

a receiver adapted to measure a characteristic of the rails in relation to the first frequency or the second frequency; and a controller connected to the transmitter and the receiver, said controller being adapted to detect the presence of the train by:

determining if the train is in an approach area based on a characteristic of the rails measured in relation to the first frequency;

determining if there is a condition that could alter the characteristic of the rails in response to determining that the train is in the approach area; and controlling the transmitter to transmit the second frequency in response to determining that there is a condition that could alter the characteristic of the rails, and detecting the presence of the train based on the characteristic of the rails measured in relation to the second frequency.

10. The constant warning time device of claim 9, wherein the controller is adapted to detect the presence of the train based on the characteristic of the rails measured in relation to the first frequency if it is determined that there is no condition that could alter the characteristic of the rail.

11. The constant warning time device of claim 9, wherein the characteristic of the rails is an impedance of the rails.

12. The constant warning time device of claim 9, wherein the condition that could alter the characteristic of the rails is a ballast condition.

13. The constant warning time device of claim 9, wherein the condition that could alter the characteristic of the rails is current leakage through a ballast.

14. The constant warning time device of claim 9, wherein the second frequency is lower than the first frequency.

15. The constant warning time device of claim 9, wherein the second frequency is approximately 45 Hz or less.

16. The constant warning time device of claim 9, wherein the controller is adapted to perform constant warning time processing based on the detected presence of the train.

17. The constant warning time device of claim 16, wherein the controller is adapted to perform constant warning time processing based on the characteristic of the rails measured in relationship to both the first frequency and the second frequency.

* * * * *